US005505648A

United States Patent [19]

Nagasawa et al.

[11] Patent Number: 5,505,648

[45] Date of Patent: Apr. 9, 1996

[54] CONTAMINATION-FREE METHOD OF MAKING ARC TUBES

[75] Inventors: Masakazu Nagasawa; Kunio Fukai; Shinichi Irisawa, all of Shimizu, Japan

[73] Assignee: Koito Manufacturing Co., Ltd., Tokyo, Japan

[21] Appl. No.: 360,945

[22] Filed: Dec. 21, 1994

[30] Foreign Application Priority Data

Dec. 21, 1993 [JP] Japan ..... 5-344709

[51] Int. Cl.[6] ..... H01J 9/32

[52] U.S. Cl. ..... 445/26; 445/42; 445/43; 445/70

[58] Field of Search ..... 445/26, 43, 33, 445/67, 70, 42

[56] References Cited

U.S. PATENT DOCUMENTS

| | | | |
|---|---|---|---|
| 3,357,600 | 12/1967 | Brooks | 222/217 |
| 3,650,304 | 3/1972 | Airola et al. | 141/2 |
| 3,685,880 | 8/1972 | Sobieski | 445/26 |
| 4,586,546 | 5/1986 | Mezei et al. | 141/2 |
| 4,799,912 | 1/1989 | Salgó | 445/26 |
| 5,286,277 | 2/1994 | Aizatulov et al. | 75/523 |

FOREIGN PATENT DOCUMENTS

| | | | |
|---|---|---|---|
| 1-267932 | 10/1989 | Japan | H01J 9/395 |

*Primary Examiner*—Kenneth J. Ramsey

*Attorney, Agent, or Firm*—Sughrue, Mion, Zinn, Macpeak & Seas

[57] ABSTRACT

In the manufacture of arc tubes for use as light sources of vehicle headlamps, there is first prepared a semifinished arc tube by inserting one electrode assembly into a tubular glass envelope through one end thereof and by sealing this end. The semifinished arc tube is then placed in communication with a hermetically enclosed space filled with argon under pressure, with the consequent introduction of the inert gas into the glass envelope through a second end thereof. Another electrode assembly and chemicals such as a metal halide and mercury are then introduced from the enclosed space into the semifinished arc tube through the second end, totally without contact with the atmospheric air. Then, with the glass envelope placed out of communication with the enclosed space, the argon is exhausted from within the envelope, and xenon is charged instead into the envelope through the second end, which is closed subsequently.

5 Claims, 10 Drawing Sheets

CONTAMINATION-FREE METHOD OF MAKING ARC TUBES

BACKGROUND OF THE INVENTION

This invention relates to a method of manufacturing arc tubes, particularly to improvements in the manufacture of arc tubes of metal halide lamps suitable for use as light sources of motor vehicle headlamps, among other applications.

Arc tubes for use as light sources of vehicular headlamps are, as the name implies, fairly short tubes of vitreous material containing two electrodes as well as chemicals such as mercury and metal halides. For the manufacture of high performance arc tubes, it is essential that the electrodes and the chemicals be introduced into the vitreous tubes without being contaminated by the atmospheric air.

Conventionally, for the attainment of this objective, there were first prepared semifinished arc tubes by inserting one electrode into one end of each vitreous tube and by sealing this end of the tube. Then the other ends of the semifinished arc tubes were inserted respectively in nozzle assemblies depending from a rotary index table. Then, with the semifinished tubes filled with an inert gas, typically argon, through conduits coupled right-angularly to the nozzle assemblies, the chemicals and the other electrodes were introduced into the semifinished tubes through the nozzle assemblies.

This conventional practice is objectionable because the passageways of the chemicals and the electrodes into the semifinished tubes through the nozzle assemblies are only partly filled with argon. The chemicals and the electrodes were left exposed to the atmospheric air both before, and halfway during, their introduction into the semifinished tubes.

SUMMARY OF THE INVENTION

The present invention seeks, in the manufacture of arc tubes of the kind defined, to avoid contact of the chemicals and electrodes with atmospheric air not only during, but also before, their introduction into semifinished tubes and hence to provide arc tubes of better, and more unfluctuating, quality than heretofore.

Stated in brief, the invention provides a method of manufacturing electric arc tubes each having first and second electrode means and required chemicals contained in a tubular envelope of vitreous material. The method dictates, first of all, the provision of a hermetically enclosed space large enough to accommodate supplies of the chemicals and the first electrode means. A semifinished arc tube is then prepared by inserting the second electrode means into a tubular envelope of vitreous material through a first end thereof and then by sealing this first end of the envelope. Then, with the enclosed space filled with an inert gas, such as argon, at a pressure somewhat above the atmospheric, the semifinished arc tube is placed in communication with the enclosed space through a second end of the envelope, with the consequent introduction of the inert gas from the enclosed space into the envelope. Then the chemicals and the first electrode means are introduced from the enclosed space into the semifinished arc tube through the second end of the envelope.

Thus, according to the invention, the chemicals and electrode means can be held standing by in the hermetically enclosed space and thence directed into the semifinished tubes. Both enclosed space and semifinished tubes, as well as passageways therebetween, are filled with an inert gas. Consequently, the chemicals and electrodes can be introduced from their standby positions into the semifinished tubes solely in an inert gas atmosphere and thus effectively protected against contamination through exposure to the atmospheric air. Preferably, for more complete protection from atmospheric contamination, the chemicals and the electrodes may be handled in sealed housings even before introduction into the enclosed space.

The above and other features and advantages of this invention and the manner of realizing them will become more apparent, and the invention itself will best be understood, from a study of the following description and appended claims, with reference had to the attached drawings showing the best mode of carrying out the invention.

DETAILED DESCRIPTION OF THE INVENTION

Figure 1:
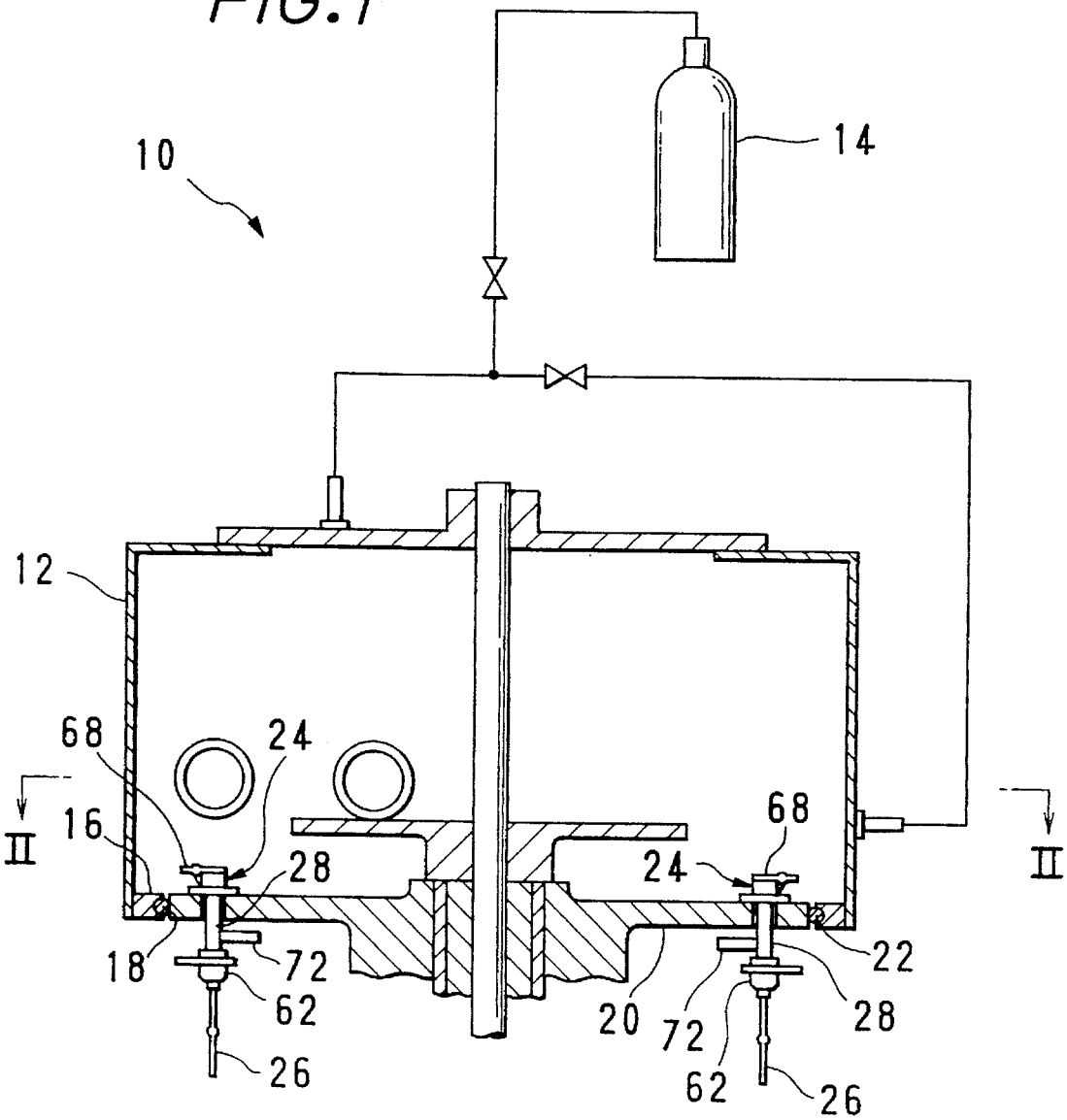
FIG. 1 is a vertical section through an example of apparatus suitable for use in the practice of this invention.
Figure 2:
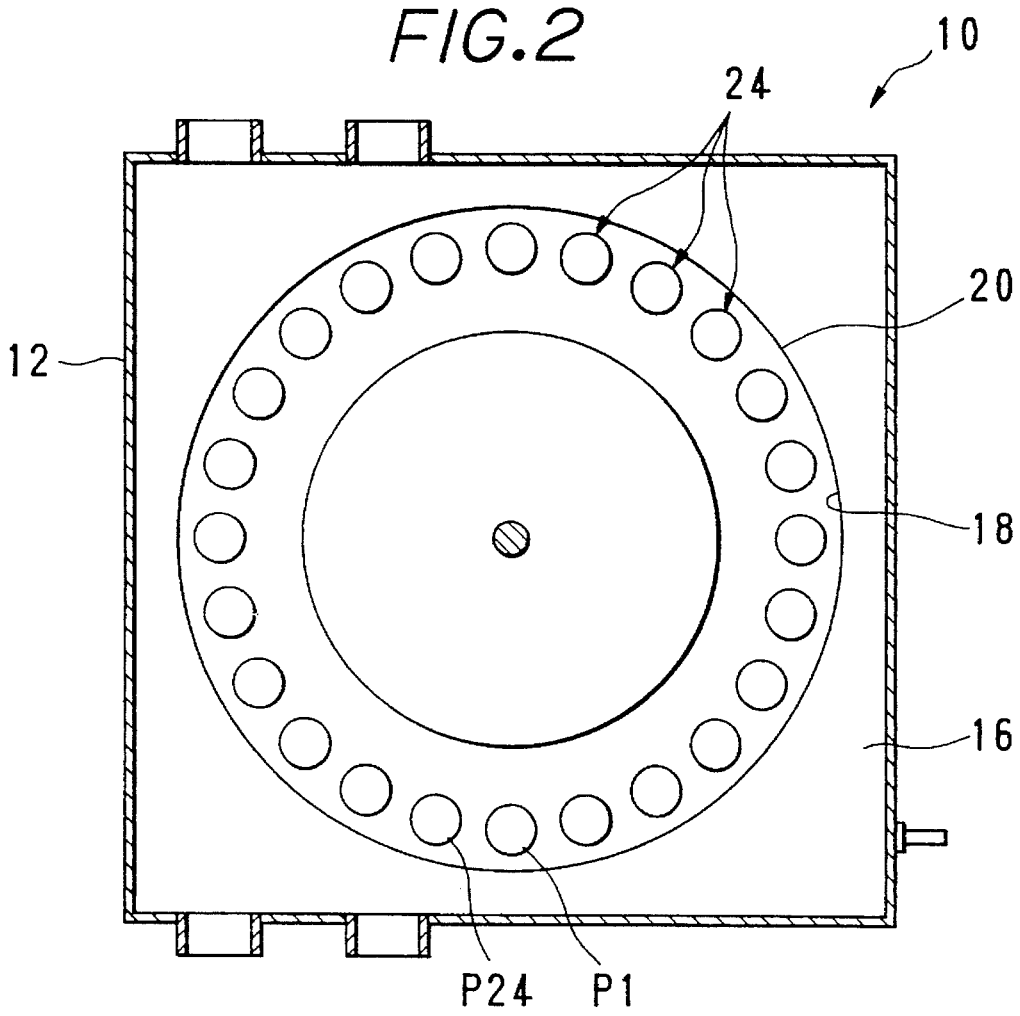
FIG. 2 is a horizontal section through the apparatus, taken along the line II—II in FIG. 1.

The arc tube manufacturing method of this invention will be better understood by first describing the apparatus currently believed to be best suited for use in mass production of metal halide arc lamps for vehicular headlamp applications according to the method. As illustrated in FIGS. 1 and 2 and therein generally designated 10, the representative apparatus has a hermetically sealed enclosure 12 of generally boxlike shape which can be placed in communication with a cylinder 14 of argon or like inert gas through suitable piping and valving.

The enclosure 12 has a bottom 16 in which there is formed an opening 18 of circular shape. Rotatably received in this opening 18 is an index table 20 which has its periphery in sliding, but practically airtight, engagement with the bottom 15 of the enclosure 12 via a sealing ring 22.

The index table 20 has a plurality or multiplicity, twenty four in this particular apparatus, nozzle assemblies 24 mounted upstandingly in as many angular positions P1–P24 thereon at constant circumferential spacings. According to the method of this invention, semifinished arc tubes 26 are to be attached to the successive nozzle assemblies 24 in position P1. As the index table 20 rotates incrementally, the required chemicals and electrode assemblies will be introduced from within the enclosure 12 into the semifinished arc tubes 26 through the nozzle assemblies 24, and globes attached to the finished arc tubes. The completed lamps will be withdrawn from the nozzle assemblies 24 in position P24. It is understood that the enclosure 12 is large enough to accommodate supplies of the chemicals and electrode assemblies to be introduced into the successive semifinished arc tubes.

All the nozzle assemblies 24 on the index table 20 are alike in construction and operation, so that the description of one applies to all the others. As pictured on an enlarged scale in FIG. 3, the representative nozzle assembly 24 has a nozzle member 28 of stainless steel or like material. Tubular in shape, the nozzle member 28 extends through a hole 30 in the index table 20, with a collar 32 on the nozzle member resting on the top of the index table. The collar 32 is fastened to the index table 20 by s plurality of, one seen, screws 34. A sealing ring 36 is provided between index table 20 and nozzle collar 32 in order to hermetically close the gap left in the hole 30 by the nozzle member 28.

The nozzle member 28 defines a passageway 37 having a tapering end portion 38 open to a downwardly open recess 40 in an externally threaded nozzle head 42 formed in one piece with the nozzle member 28. The nozzle head 42 houses the following means to hermetically engage and hold one end of each semifinished arc tube 26 for introduction of the chemicals and electrode means therein. Such means include a metal made bushing 44, an elastic sealing ring or sleeve 46, and another metal made bushing 48, arranged in that order from top to bottom and all cylindrical in shape and having holes 50, 52 and 54 extending therethrough in axial alignment with one another and with the passageway 37 in the nozzle member 28.

The bottom bushing 48, less in diameter than the top bushing 44 and sealing sleeve 46, extends with clearance through a hole 56 in a thrust bearing 58 and a hole 60 in a cap nut 62. The bottom bushing 48 has a flange 64 just under the sealing sleeve 46 to bear against the thrust bearing 58 and thence against the cap nut 62 which is screwed onto the externally threaded nozzle head 42. The cap nut 62 has a lever 66 projecting radially therefrom.

Thus, as the cap nut 62 is turned with the lever 66 in a predetermined tightening direction, the bottom bushing 48 will be forced into the nozzle head 42 via the thrust bearing 58. Compressed between the two metal made bushings 44 and 48, the elastic sealing sleeve 46 will undergo radial expansion thereby frictionally and hermetically holding one end of the semifinished arc tube 26, as will be later explained in more detail.

The nozzle member 28 has a flap valve 68 hingedly mounted on its top thereby to be placed in and out of communication with the interior of the enclosure 12. The flap valve 68 is to be opened for introduction of the chemicals and electrode means into the semifinished arc tube 26. A sealing ring 70 is shown provided between nozzle member 28 and flap valve 68 in order to assure gastight discommunication of the nozzle member passageway 37 from the interior of the enclosure 12 when the valve is closed.

Figure 3:
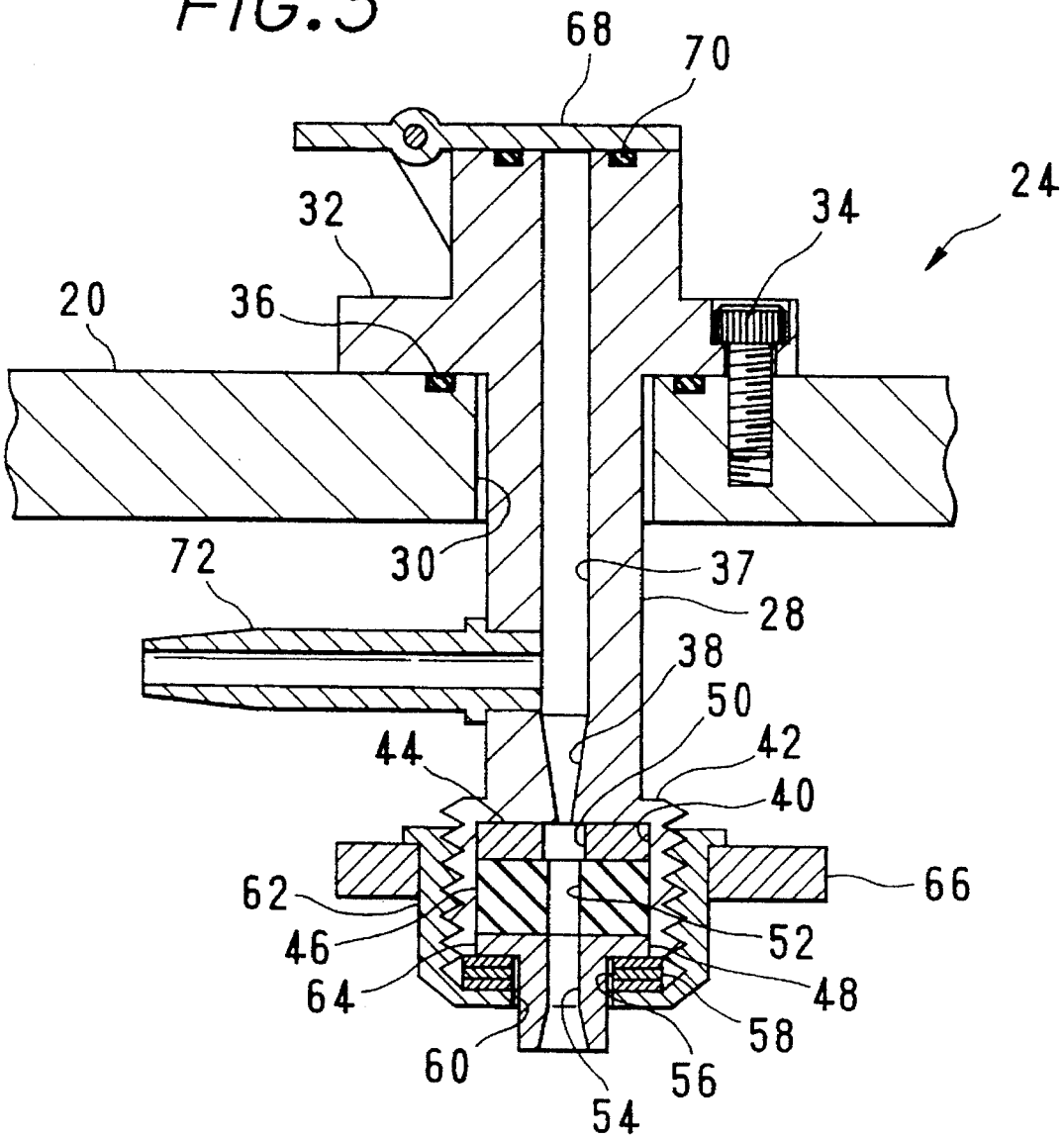
FIG. 3 is an enlarged section through one of the nozzle assemblies of the FIG. 1 apparatus.

FIG. 3 also shows a branch conduit 72 coupled to the nozzle member 28 of each nozzle assembly 24 in a position just above the ta-pering end portion 38 of the passageway 37. This branch conduit 72 has a solenoid valve, not shown, for selectively placing the nozzle member 28, and therefore the semifinished arc tube 26 coupled thereto, in and out of communication with an exhaust pump or with a source of an arc tube gas, preferably xenon, under pressure.

Figure 4A:
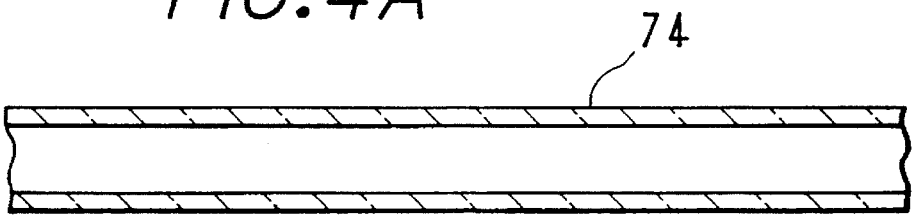
FIGS. 4A–4C are a series of sectional illustrations explanatory of how a tube of vitreous material is processed into a semifinished arc tube to be handled by the FIG. 1 apparatus.
Figure 4B:
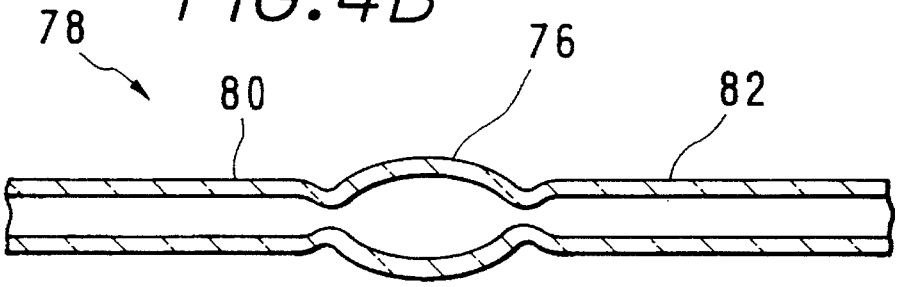
Figure 4C:
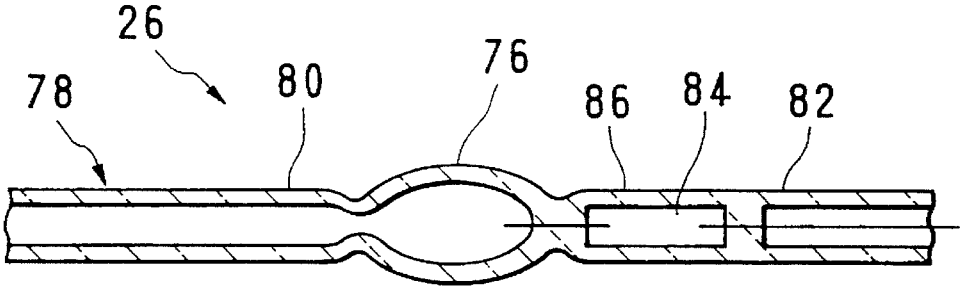

Such being the preferred construction of the apparatus 10 for use in the practice of the method of this invention, arc tubes may be manufactured in the following manner:

There may first be prepared semifinished arc tubes 26 through the procedure depicted in FIGS. 4A–4C. A tubular blank 74, FIG. 4A, of vitreous material may be heated and molded to form a globe 76, FIG 4B, in its middle. There is thus formed a semifinished arc tube envelope 78 having the globe 76 and two tubular sections 80 and 82 extending in opposite directions therefrom. Then, as illustrated in FIG. 4C, one electrode assembly 84 is inserted in one tubular section 82 of the semifinished arc tube envelope 78. Then this tubular section 82 is pinch sealed at its junction with the globe 76, with the result that the electrode assembly 84 becomes partly embedded in the pinch seal 86, partly protruding into the globe 76.

Now has been completed the preparation of the semifinished arc tube 26 comprising the envelope 78 and the electrode assembly 84. Many such semifinished arc tubes may be fabricated in a like manner. The other electrode assembly, as well as the required chemicals, is to be introduced into each semifinished arc tube by use of the apparatus 10.

Preparatory to mounting the semifinished arc tubes 26 to the nozzle assemblies 24, these nozzle assemblies may be discommunicated from within the enclosure 12 by closing the flap valves 68 as shown in FIG. 3. Argon may be allowed to flow from its source 14 into the enclosure 12 until the gas pressure within the enclosure builds up somewhat above the atmospheric.

Then come the step of mounting the semifinished arc tubes 26 to the successive nozzle assemblies 24. Once mounted to the nozzle assemblies 24, the semifinished arc tubes 26 will be processed into finished products by the same method. Therefore, how one semifinished arc tube 26 is mounted to one nozzle assembly 24 and subsequently operated upon into a completed arc tube will be described in detail, it being understood that the same description applies to all the other semifinished arc tubes mounted to all the other nozzle assemblies 24.

Figure 5:
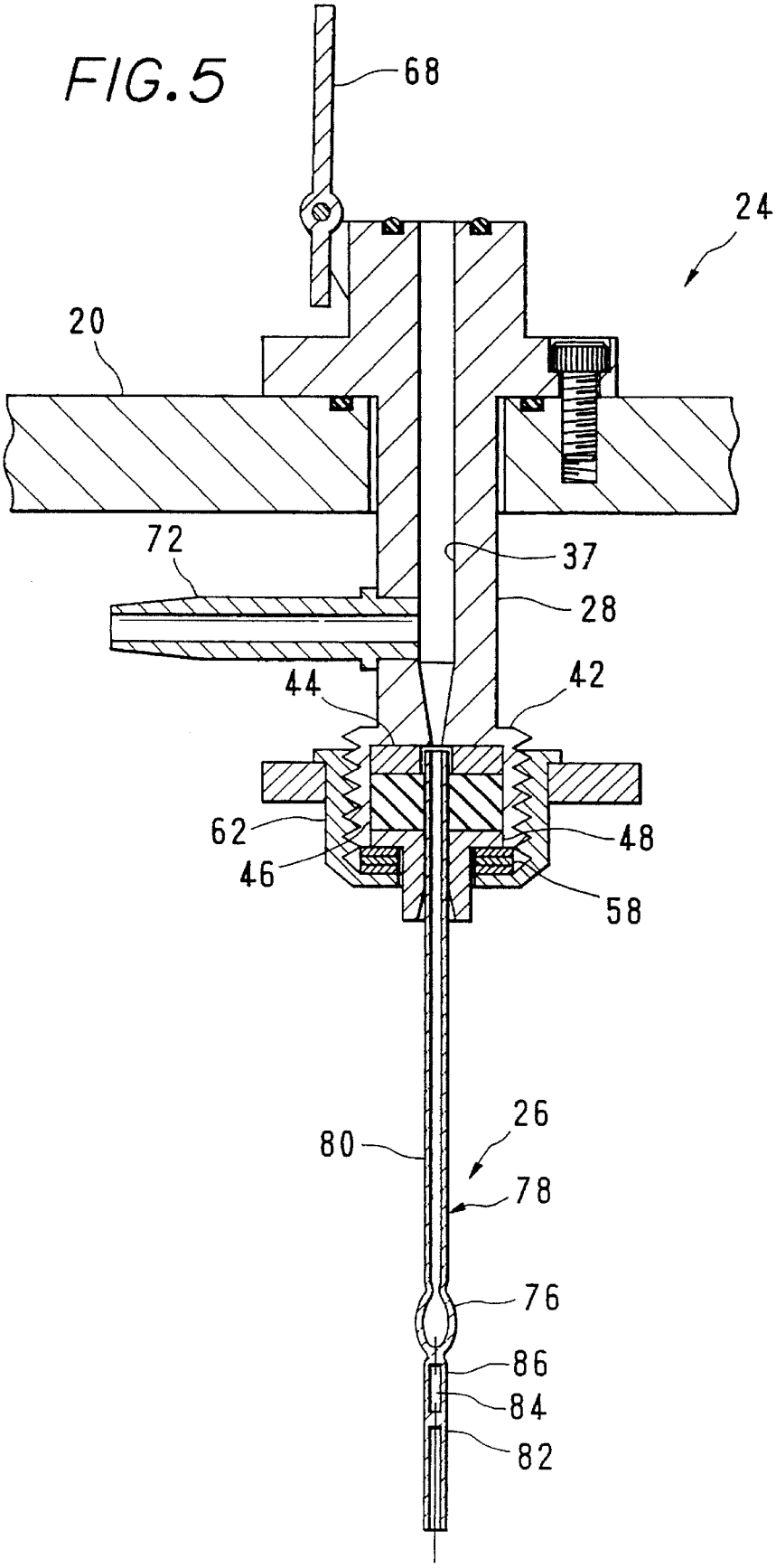
FIG. 5 is a view similar to FIG. 3 except that the nozzle assembly is shown together with the semifinished arc tube coupled thereto.

The cap nut 62 of the nozzle assembly 24 may be loosened by the lever 66 in the position P1. Then the tubular section 80 of one semifinished arc tube 26 may be inserted into the bushing 48, sealing sleeve 46 and bushing 44 until the semifinished arc tube butts endwise against the nozzle member 28, as illustrated in FIG. 5. Then the cap nut 62 may be retightened. With the bottom bushing 48 thus forced up into the nozzle head 42 via the thrust bearing 58, the sealing sleeve 46 will be compressed between the two bushings 44 and 48 thereby expanding radially into gastight, frictional contact with the tubular section 80 of the semifinished arc tube 26. The mounting of one semifinished arc tube 26 to one nozzle assembly 24 has now been completed.

Then, with the flap valve 68 held closed as in FIG. 3, the unshown solenoid valve may be actuated to communicate the branch conduit 72 with the exhaust pump, thereby evacuating the passageway 37 in the nozzle member 28 and hence the interior of the semifinished arc tube 26. Then the solenoid valve may be closed, and the flap valve 68 opened instead as shown in FIG. 5. Then the argon will flow from within the enclosure 12 into the nozzle member 28 and hence into the semifinished arc tube 26.

Figure 6:
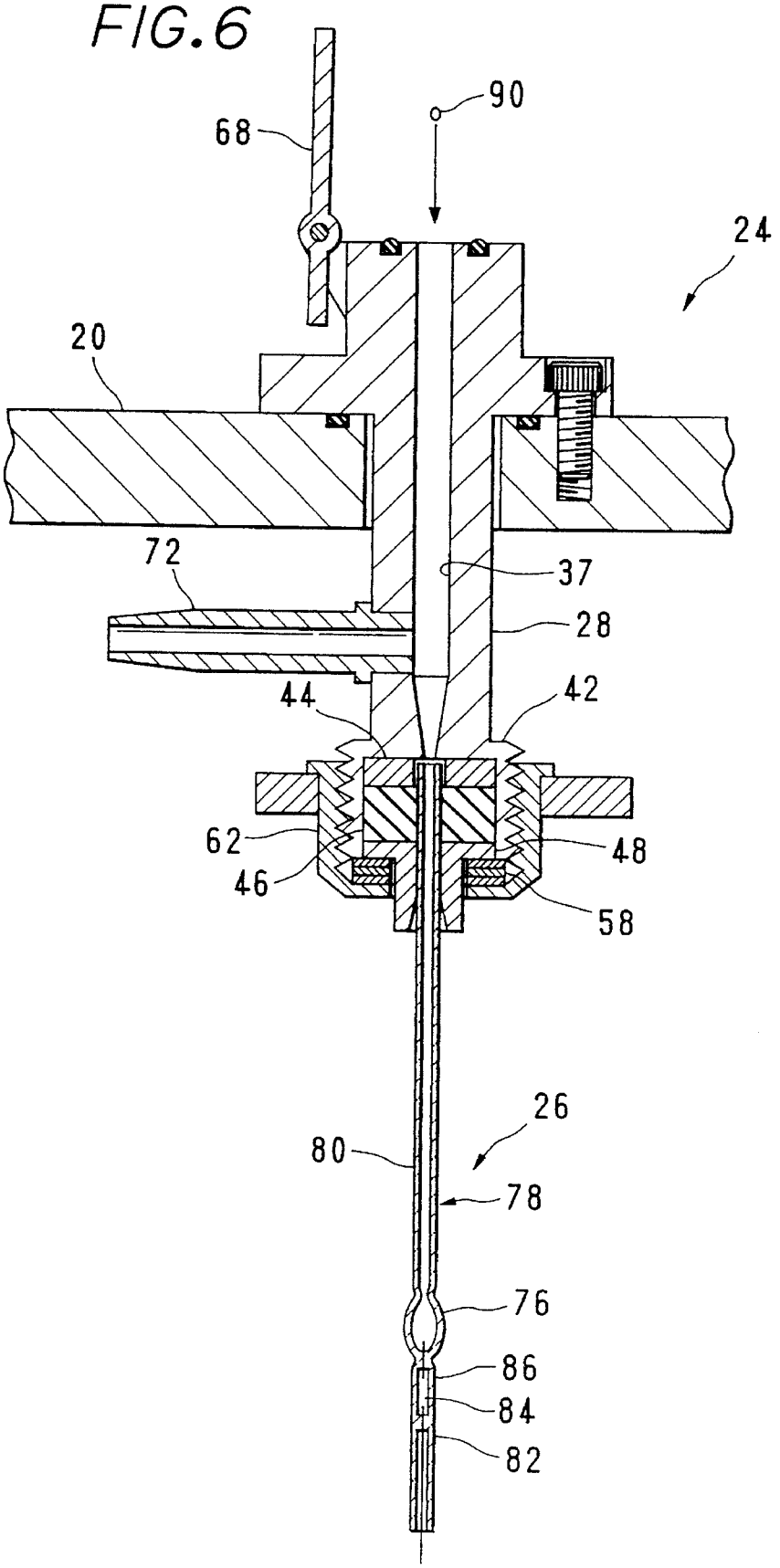
FIG. 6 is a view similar to FIG. 5 except that mercury is shown being introduced into the semifinished arc tube.

As the chemicals needed by the arc tube being manufactured, mercury may first be introduced from its supply within the enclosure 12 into the semifinished arc tube 26. To this end the mercury 90, FIG. 6, may be caused to adhere by surface tension to the tip of a tube and to drop into the nozzle member 28 and, eventually, into the globe 76 of the semifinished arc tube 26.

Figure 7:
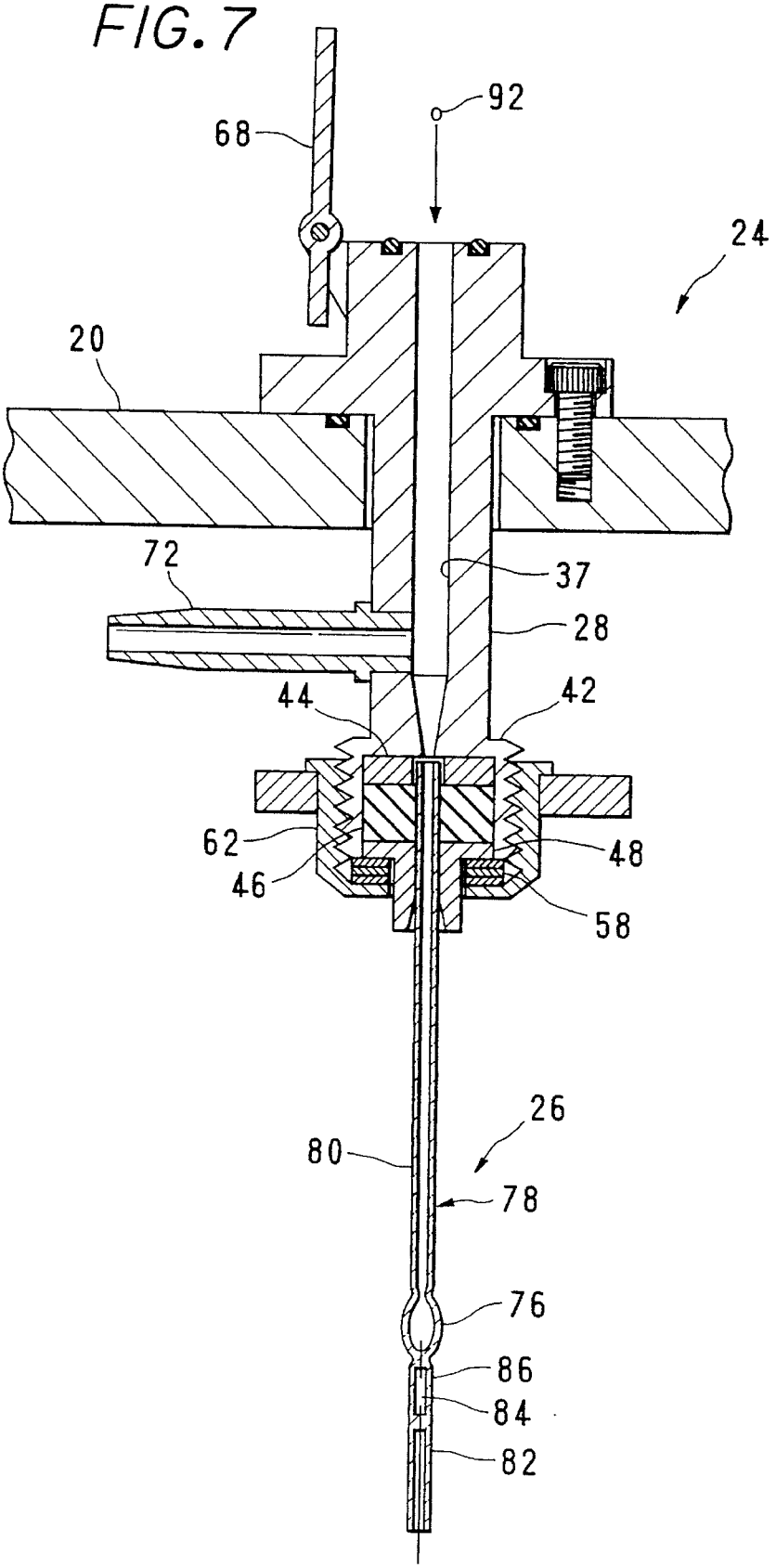
FIG. 7 is a view similar to FIG. 5 except that a metal halide is shown being introduced into the semifinished arc tube.

A metal halide, another chemical required, may be prepared in the form of pellets within the enclosure 12. The pelletized metal halide 92, FIG. 7, may be dropped into the nozzle member 28 and thence into the globe 76 of the semifinished arc tube 26.

Figure 8:
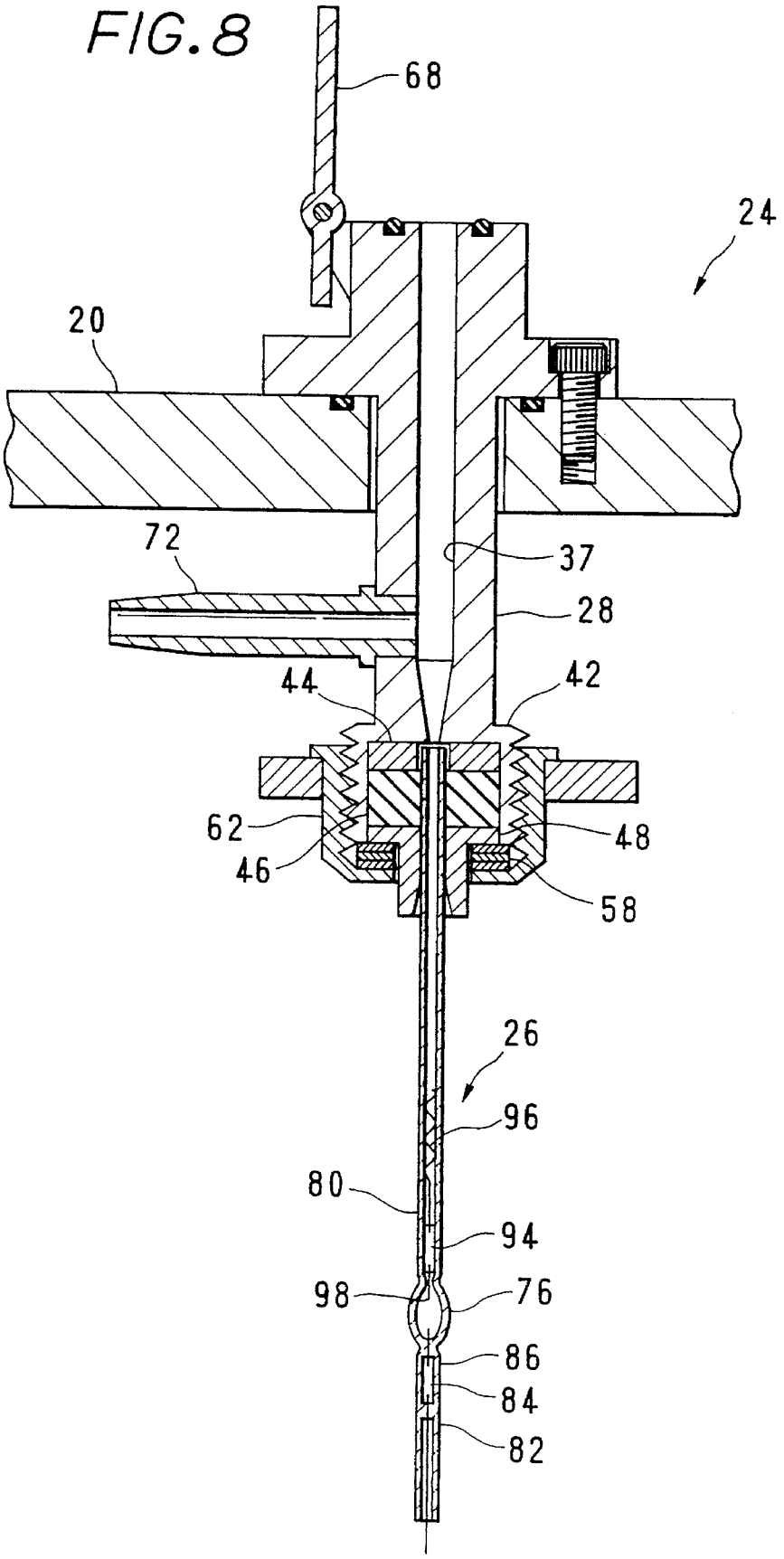
FIG. 8 is a view similar to FIG. 5 except that a second electrode assembly is shown inserted in the semifinished arc tube.

Next come the introduction of a second electrode assembly 94, FIG. 8, similar to the first 84 already installed in the semifinished arc tube 26. From among a large number of second electrode assemblies held in stock within the enclosure 12, one may be dropped into the nozzle member 28 and thence into the tubular section 80, and partly into the globe 76, of the semifinished arc tube 26. Preferably, part of the lead 96 of the second electrode assembly 94 may be preformed into a helix with an outside diameter similar to the inside diameter of the tubular section 80 of the semifinished arc tube 26, in order that the electrode 98 of the second electrode assembly may be positioned precisely axially of the envelope.

Then the flap valve 68 may be closed, and the argon may be pumped away from within the semifinished arc tube 26 by way of the branch conduit 72. Then, with the flap valve 68 held closed, xenon may be introduced by way of the same branch conduit 72 into the semifinished arc tube 26 to a preassigned pressure that can be less than the atmospheric.

Figure 9:
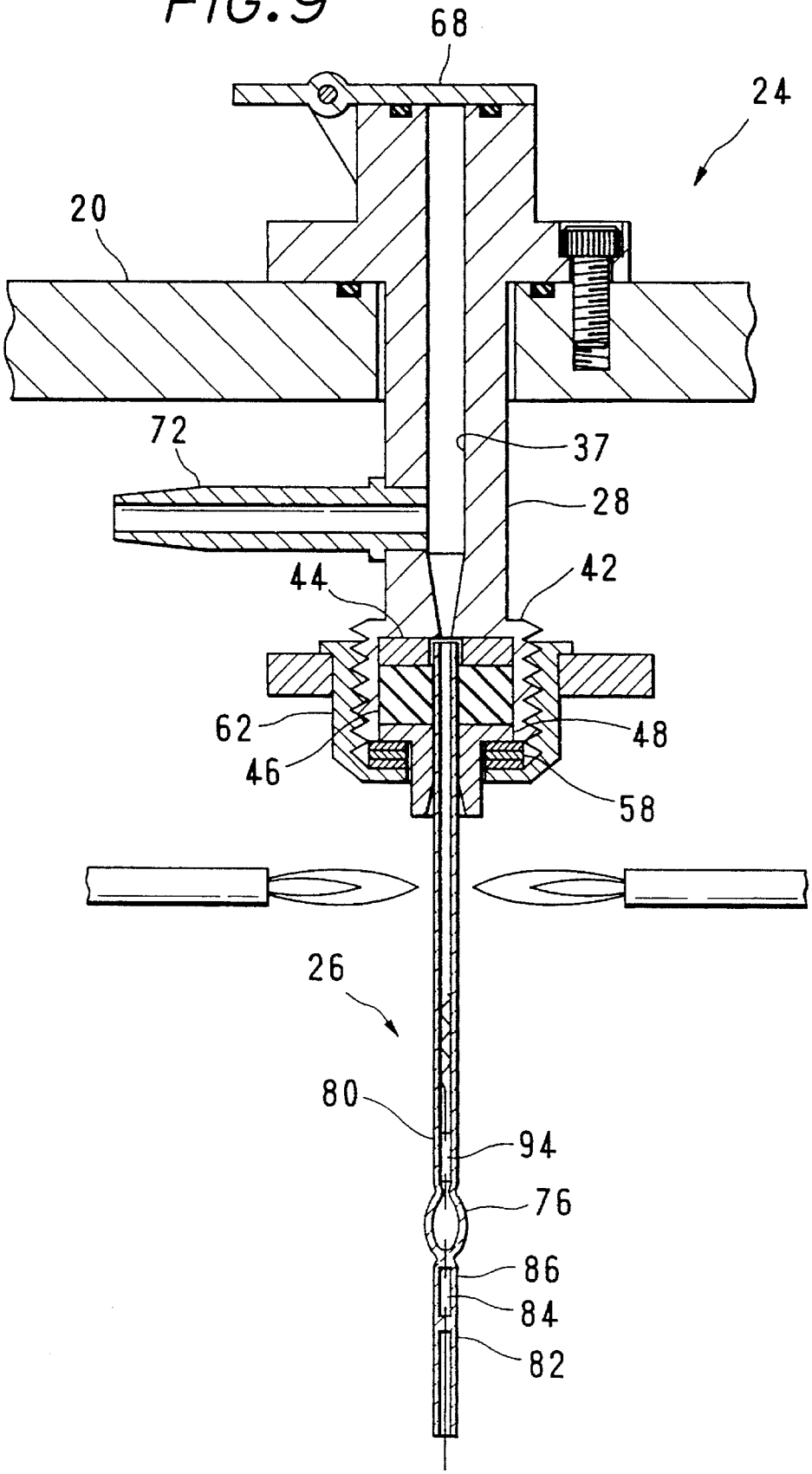
FIG. 9 is a view similar to FIG. 5 except that the semifinished arc tube is shown being tipped off.
Figure 10:
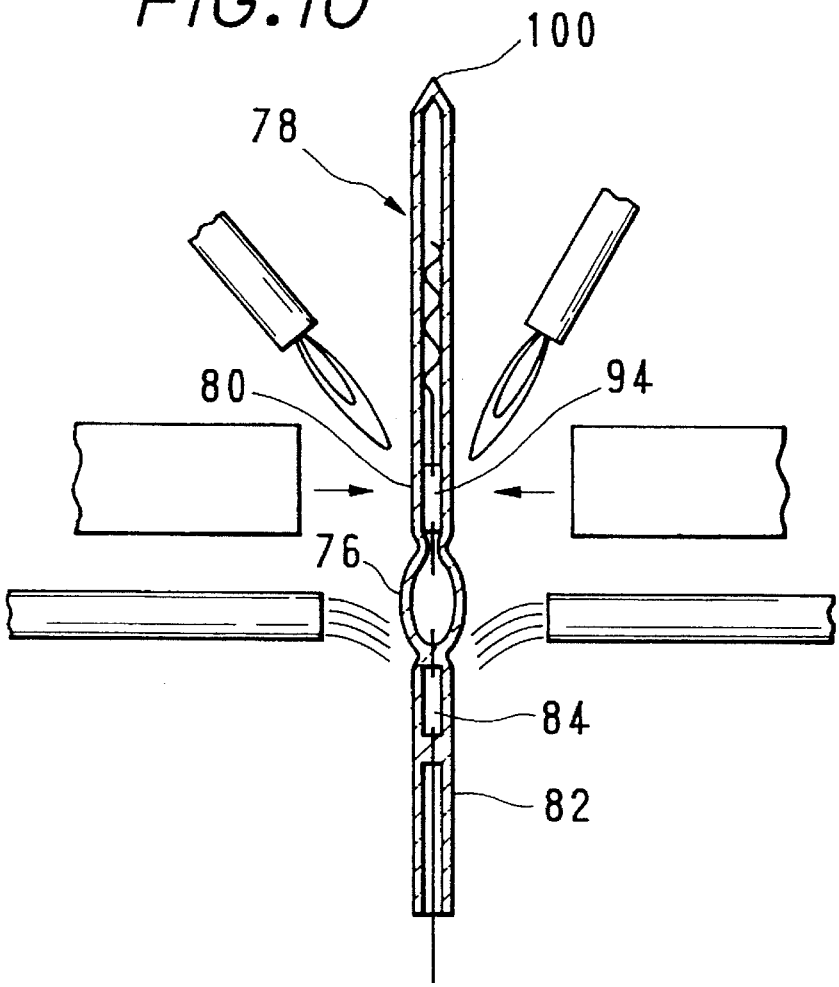
FIG. 10 is a view showing how the semifinished arc tube is pinch sealed after having been tipped off.
Figure 11:
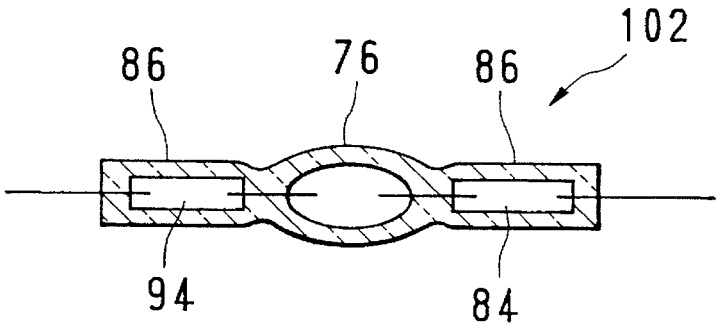
FIG. 11 is an enlarged section through a completed arc tube.

Then, as pictured in FIG. 9, the tubular section 80 of the envelope 78 may be heated and tipped off at a point just below the nozzle assembly 24. The tubular section 80 will then be hermetically closed, as indicated at 100 in FIG. 10. Then, as shown also in FIG. 10, the junction between globe 76 and tubular section 80 may be heated and pinch sealed while the globe is being cooled as by liquid nitrogen in order to keep condensed the xenon contained therein. Then the article of FIG. 10 may have its excess parts cut off, and may be put to aging, to obtain a completed arc tube 102, FIG. 11.

Preferably, in the practice of this invention, the chemicals such as mercury and metal halides to be sealed in arc tubes should be handled in gastight containers in order to avoid exposure to atmospheric air from the moment of their manufacture to that of their introduction into the enclosure 12. The electrode assemblies may also be placed in gastight containers in an inert gas atmosphere after having been gas cleansed, and may be carried in the gastight containers into the enclosure 12. In this manner, since the enclosure 12 communicates with the semifinished arc tubes 26 in an inert gas atmosphere, the chemicals and the electrode assemblies can both be protected from atmospheric contamination.

Despite the foregoing detailed disclosure, it is not desired that the invention be limited by the exact showing of the drawings or the description thereof, for the method of this invention could obviously be practiced by means other than those illustrated. A variety of modifications and alterations will suggest themselves to the specialists in order to conform to the requirements of each specific application of the invention, without in any way departing from the scope of the invention as expressed in the ensuing claims.

What is claimed is:

1. A method of manufacturing arc tubes each having first and second electrode means and required chemicals contained in a tubular envelope of vitreous material, which method comprises:

(a) providing a hermetically enclosed space large enough to accommodate supplies of the chemicals and the first electrode means;

(b) preparing a semifinished arc tube by inserting the second electrode means into a tubular envelope of vitreous material through a first end thereof and by sealing the first end of the envelope;

(c) filling the hermetically enclosed space with an inert gas under pressure;

(d) placing the semifinished arc tube in communication with the enclosed space through a second end of the envelope, with the consequent introduction of the inert gas from the enclosed space into the envelope; and (e) introducing the chemicals and the first electrode means from the enclosed space into the semifinished arc tube through the second end of the envelope;

(f) whereby the chemicals and the first electrode means are effectively protected by the inert gas against contamination through exposure to atmospheric air during their introduction into the semifinished arc tube.

2. The method of claim 1 which further comprises:

(a) placing the envelope out of communication with the hermetically enclosed space following the introduction of the chemicals and the first electrode means therein;

(b) exhausting the inert gas from within the envelope;

(c) introducing another gas into the envelope; and (d) sealing the second end of the envelope.

3. The method of claim 1 wherein the inert gas is argon.

4. A method of manufacturing arc tubes suitable for use as light sources of vehicular headlamps, among other applications, with each arc tube having first and second electrode means, mercury, and a metal halide contained in a tubular envelope of vitreous material, which method comprises:

(a) providing a hermetically enclosed space large enough to accommodate supplies of mercury, the metal halide, and the first electrode means;

(b) preparing a semifinished arc tube by inserting the second electrode means into a tubular envelope of vitreous material through a first end thereof and by sealing the first end of the envelope;

(c) filling the hermetically enclosed space with an inert gas under pressure;

(d) placing the semifinished arc tube in communication with the enclosed space through a second end of the envelope, with the consequent introduction of the inert gas from the enclosed space into the envelope; and (e) introducing the mercury, the metal halide and the first electrode means from the enclosed space into the semifinished arc tube through the second end of the envelope;

(f) placing the envelope out of communication with the enclosed space following the introduction of the mercury and the metal halide and first electrode means therein;

(g) exhausting the inert gas from within the envelope;

(h) introducing xenon into the envelope; and (i) sealing the second end of the envelope;

(j) whereby the chemicals and the first electrode means are effectively protected by the inert gas against contamination through exposure to atmospheric air during their introduction into the semifinished arc tube.

5. The method of claim 4 wherein the inert gas is argon.

* * * * *